United States Patent [19]

Jenkins, Sr.

[11] 4,133,366

[45] Jan. 9, 1979

[54] SCREEN MOUNTING ARRANGEMENT

[75] Inventor: Robert A. Jenkins, Sr., Farmington, Mich.

[73] Assignee: Solar Reflective Film, Inc., Detroit, Mich.

[21] Appl. No.: 823,985

[22] Filed: Aug. 12, 1977

[51] Int. Cl.[2] ..... E06B 9/52

[52] U.S. Cl. ..... 160/328

[58] Field of Search ..... 160/327–329, 160/368 R, 378, 178 R; 248/204, 300, 317, 316 D; 85/36; 151/41.75; 24/73 B

[56] References Cited

U.S. PATENT DOCUMENTS

| | | | |
|---|---|---|---|
| 1,672,896 | 6/1928 | Marshall | 160/328 |
| 1,950,250 | 3/1934 | Kinney | 248/300 |
| 2,889,876 | 6/1959 | Lockhart | 160/328 |

*Primary Examiner*—Peter M. Caun

*Attorney, Agent, or Firm*—Krass & Young

[57] ABSTRACT

A mounting arrangement for stretching mounting panels of flexible sheet material, disclosed as solar screening mesh, within openings such as window frames, including tensioner channel members secured to opposite edges of the screen panel, each tensioner channel being disclosed as an extrusion of identical cross-sectional shape and each including a recess within which is retained a retainer bar with the screen panel material passing around the retainer bar within the recess frictionally secured within the recess. A lip edge opposite the recess is formed on each tensioner channel, one of the tensioner channels lip edge hooked by rigid clip members fastened to the opening frame, while the other tensioner channel is resiliently supported to an opposing frame member by C-shaped spring clips secured to the window frame member. The C-clip spring members are adapted to resiliently tension the screen panel by means of a resilient force exerted on the other tensioner channel member to maintain the screen panel in tension when mounted within the opening and also allowing quick release of the lower panel edge by allowing resilient yielding of the C-clip sufficient to enable unhooking of the one tensioner channel.

15 Claims, 5 Drawing Figures

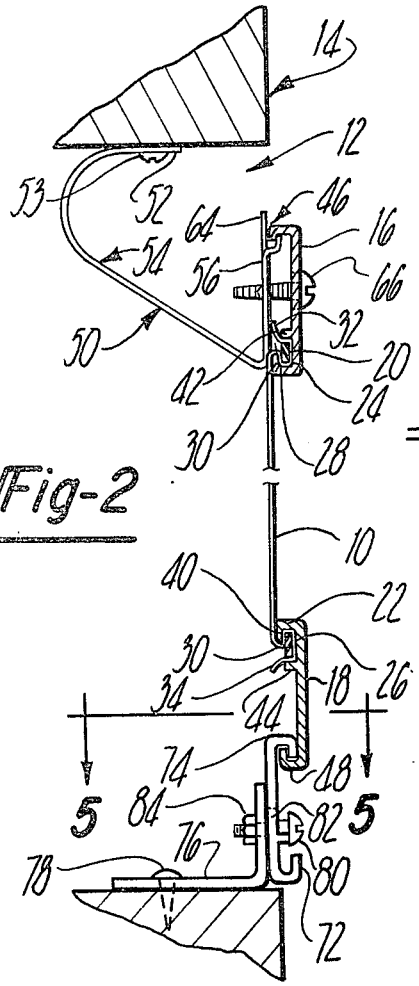
Fig-2
Fig-1
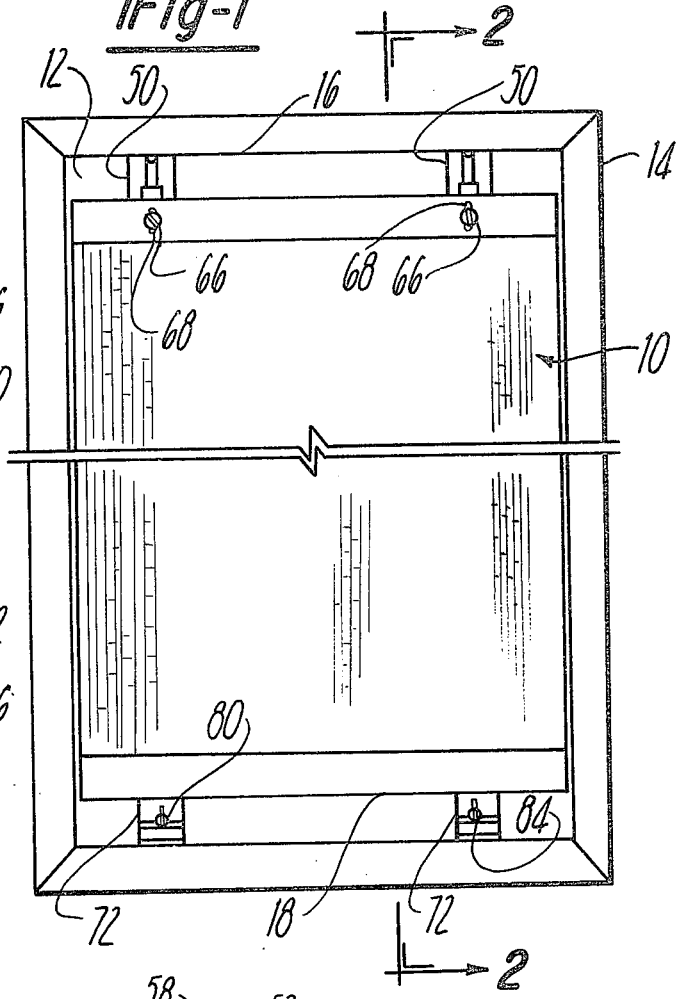
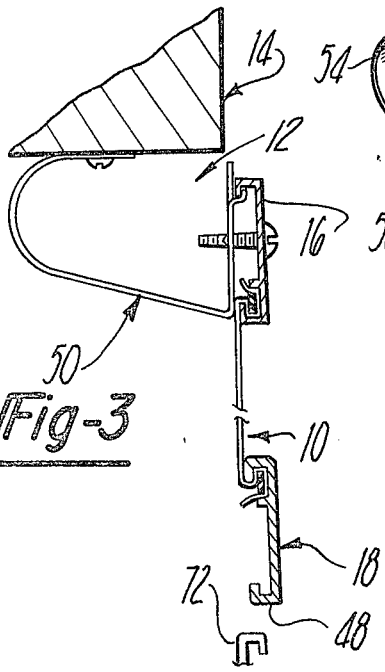
Fig-3
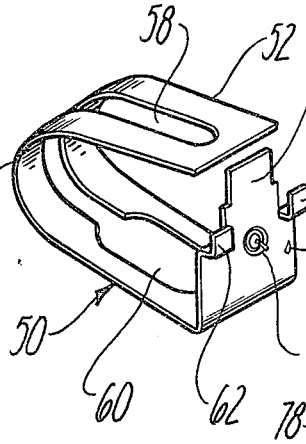
Fig-4
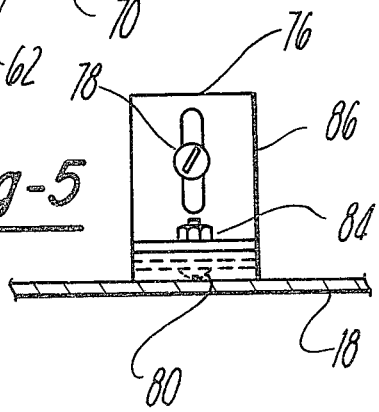
Fig-5

SCREEN MOUNTING ARRANGEMENT

BACKGROUND OF THE INVENTION

1. Field of the Invention

This invention concerns mounting arrangements for securing flexible panels within openings and more particularly such mounting arrangements in which the flexible panels are tensioned or stretched within the opening.

2. Description of the Prior Art

The current emphasis on energy conservation had led to the development of solar screening for the windows of commercial and industrial buildings and residences. Such screening has taken the form of open weave mesh material of vinyl plastic or other material and is adapted to be mounted within or in front of the window by securement in some manner to the window frame. Any such mounting arrangement of course must provide for relatively convenient and expeditious installation of the solar screening, particularly for office or other building installations often involving large numbers of such solar screening panels to be installed commonly at levels far above grade.

Another requirement is the properly tensioned securing of the screen panel members. Since these panels are of flexible material, considerations of both aesthetics and wind resistance would require that these panels be securely tensioned within the openings.

Furthermore, the mounting arrangement would advantageously be readily adapted to various window frame sizes and configurations so as to not require the manufacture and inventory of numerous differing mounting components leading to administrative costs and labor costs intended to the increased complexities of installation.

Another factor is the ease with which the solar screen may be detached from its mount, at least on one end thereof so that necessary building maintenance may be carried out without being greatly hindered by the screen, such as the washing of the windows, painting of frames, etc. While the solar screening materials developed to date serve to protect the window and frame, reducing such maintenance requirements considerably, such maintenance must still be performed, albeit at much longer intervals.

Of course, any item destined for commercial application should be of the maximum practical simplicity in order that its cost may be minimized and the mounting hardware for these applications is no exception.

Similarly, the aesthetic appearance of such mounting arrangement while perhaps not of paramount concern in commercial and office building installations, must nonetheless present a reasonably aesthetic outward appearance, compatible with pleasing building design. A typical prior art approach to requirements in the context of an insect window screen is disclosed in the Dominick U.S. Pat. No. 1,705,442 which does involve the mounting of a flexible screening panel within a window opening and which exerts a tension on the flexible screening member and which is also readily releasable at its lower edge. While this arrangement would appear to perform satisfactorily, certain aspects of the design could well be improved particularly for solar screen applications.

Firstly, the mounting arrangement is relatively complex involving a considerable number of components. In addition, the means of attachment of the screening to the tensioning components of the mounting arrangement requires the use of screws and adds to the labor involved in the installation of the unit. In addition, some of the components which afford the resilient mounting thereof are of elaborate configuration which would add to the costs of the fabrication of the complete device. In addition, the adaptability of the arrangement to windows of varying widths is not great and it appears that spring configurations would of necessity be stocked and for various window widths to compromise the ready adaptability of the mounting arrangement to varying window dimensions.

It is an object of the present invention to provide a mounting arrangement for flexible screen panels for mounting these panels within openings such as window frames in which the flexible panel is tensioned within the opening and mounted for ready release thereof. This mounting arrangement is to be provided with components of maximum simplicity both in configuration and in the number of components required.

It is yet another object of the present invention to provide such a mounting arrangement which is readily adaptable to differing installations such as varying window frame dimensions and/or frame configurations with a minimum modification or variation in the components required.

It is still another object of the present invention to provide such a mounting arrangement which securely retains the flexible screen panel in a manner which is aesthetically pleasing such as to be compatible with good building design.

SUMMARY OF THE INVENTION

These and other objects, which will become apparent upon a reading of the following specification and claims, are accomplished by a mounting arrangement including a pair of tensioner channel members secured to the upper and lower edges of the screen panel, respectively, by means of retainer recesses formed therein in which is disposed a retainer bar encircled by the upper and lower edges of the flexible panel in the recesses, the flexible panel retained therein by the presence of the retainer bar. The tensioner channels are also formed along their opposite sides with lip edges, one, the lower of the two tensioner channels is retained by rigid hook clips engaging the lip edge. The rigid clip element is comprised of sections of the same cross sectional section as forms the tensioner channel members, such that a common extrusion can be utilized for all three elements. A slotted angle bracket mounted to the window frame adjustably mounts the rigid clips to the window frame. The other or upper tensioner channel is resiliently retained within the opening by means of C-clips being directly mounted to the window frame by screws passing through the C-clip slots, the other end of the C-clips having tab portions adapted to hook the tensioner channel lip and screws passing through both the tensioner channel member and the C-clip securing the C-clips in position with the tabs in hooking engagement with the tensioner channel lip edge. Each of these C-clips is positioned within the opening such that a resilient tension force is exerted on the tensioner channel secured thereto upon positioning of the lower tensioner channel to bring the rigid clips into hooking engagement with the other tensioner channel lip such as to releasably mount the panel in tension with the window opening.

DESCRIPTION OF THE DRAWINGS

FIG. 1 is a front elevational view of a solar screening panel mounted within a window frame by the mounting arrangement according to the present invention.

FIG. 2 is an enlarged view of the section 2—2 taken in FIG. 1.

FIG. 3 is a view of the section shown in FIG. 2 with the flexible screen panel shown in the released condition.

FIG. 4 is a perspective view of one of the C-clip members utilized to secure one of the edges of the flexible panel and exert the tensioning forces on the flexible panel members.

FIG. 5 shows the view of the section 5—5 taken in FIG. 2 showing the details of installation of the rigid clip members utilized to retain the lower tensioner channel member within the window frame.

DETAILED DESCRIPTION

In the following detailed description, certain specific terminology will be utilized for the sake of clarity and a specific embodiment utilized in accordance with 35 USC 112, but it is to be understood that the same is not intended to be limiting and indeed should not be so construed inasmuch as the invention is capable of taking many forms and variations within the scope of the appended claims.

Referring to the drawings and particularly FIG. 1, the inventive mounting arrangement is contemplated as being applied to the installation of a solar reflective mesh panel 10 which is formed from an open weave vinyl plastic material which transmits a fraction of the light therethrough such that occupants of the building may still look through the flexible panel 10 while reducing the solar radiation passing through the window to a small fraction of an unscreened window to thereby effect substantial energy savings in the cooling of the building.

The flexible screening panel 10 is fit within an opening 12 within a window frame 14 shown for exemplary purposes only. The mounting arrangement according to the present invention includes the securement of the flexible panel 10, a pair of tensioner panels 16 and 18, one of the tensioner channels 16 affixed to the upper edge 32 thereof and the other tensioner channel 18 secured to the lower opposite edge 34 of the flexible panel 10.

As shown in the enlarged sectional view of FIG. 2, the securement of the flexible panel 10 is by means of a retainer bar 20 in the upper tensioner channel 16 and a retainer bar 22 disposed within and carried by the lower tensioner channel 18. This securement is by virtue of the positioning of each of the retainer bars 20 and 22 disposed within a recess 24, formed in the tensioner channel 16 and a recess 26 in the lower tensioner channel 18.

Each of the recesses 24 and 26 are configured such as to substantially enclose the retainer bars 20 and 22, with an opening 28 and 30 remaining allowing the flexible channel material to pass into each recess 24 and 26, passing around each retainer bar 20 and 22 exiting through the same opening 20 or 30.

To install the upper and lower edges 32 and 34 of the flexible panel 10, the edge need only be laid over the retainer recesses 24 and 26 and the respective retainer bars 20 and 22 pressed into the recesses trapping the edges 32 and 34 within the recesses to securely retain them. The lip portions 38 and 40 constituting part of the recesses 24 and 26 are directed away from the direction of tension of the flexible panel member such as to tend to force each retainer bar 24 and 26 against protrusions 42 and 44, each forming a portion of the respective recess 24 and 26 such that the tensile forces exerted on the flexible panel member 10 do not produce dislodgement of the retainer bar 20 or 22 so that the upper and lower edges of the flexible panel 10 are easily but firmly secured to the upper and lower tensioner channels 16 and 18, respectively. The retainer bars may be made of plastic strip at low cost.

The opposite side of each tensioner channels 16 and 18 from the retainer recesses 20 and 22 are formed with inwardly turned lip edges 46 and 48 which serve as engagement surfaces with the mounting hardware.

It should be noted that the upper tensioner channel 16 and the lower tensioner channel 18 are thus of identical cross sectional shape, merely being installed in a reversely oriented position, such that the same members may be utilized for both tensioner channel members. This cross sectional shape is one that is easily formed by aluminum extrusion methods and accordingly may be fabricated at very low cost.

In addition, being an extrusion, it is merely cut to appropriate lengths as may be the retainer bars 24 and 26 such that this aspect of the mounting arrangement is readily adaptable to panel widths of any dimension by merely cutting the member to the appropriate lengths.

One of the tensioner channels, here shown as the upper tensioner channel 16, is secured within the opening frame 14 by means of a plurality of C-clips 50. In most instances, two of such clips would be adequate to support the upper tensioner channel 16 across its length although the number of such C-clips 50 may easily be increased to provide adequate support for panel widths of relatively great dimension. Each C-clip 50 is mounted to the frame 14 by means of a screw or similar fastener securing an upper flattened end portion 52 to the interior surface of the frame 14 as shown. The C-clip 50 extends rearwardly into the opening 12 and then is bent reversely by means of an intermediate reversely bent spring section 54 extending outwardly from the opening 12 to a point in approximate alignment with the plane of the opening of the frame 14 if a substantially flush mounting of the flexible panel 10 is desired.

At this point, a reversely formed mounting tang 56 is provided bent at an appropriate angle to the spring section 54 to place the face therof in an approximately vertical plane. The portions 52 and 54 of the C-clip 50 are slotted at 58 with an increased slot dimension at 60 in order to reduce the spring rate of the C-clip 50 and also afford an adjustable mounting opening as per the opening in the slot portion 52, so as to allow the adjustment of the position of the C-clip 50 with respect to the frame 14. This thereby adjusts the position of the flexible panel 10 with respect to the opening 12.

This slotting also provides a convenient means of creating a suitably low spring rate of the spring section 54 and allowing the establishment of the proper tension level of the flexible panel 10.

This also accommodates a relatively large deflecting movement of the flexible panel 10 for release thereof, as will be described, and to accommodate thermal expansion and contraction of the flexible panel 10, while still insuring adequate tension to be applied to the flexible panel 10.

The mounting tang 56 includes a pair of tabs 62 which are bent outwardly from the front face of the tang 56 and thence bent upwardly so as to provide hooking edges which may be disposed beneath the lip edge 46 formed on the tensioner channel 16. The intermediate portion of the tang 56 from which the tab 62 may be formed provides an abutment engaging the outer surface of the terminal lip portion of the edge 46 such that the tensioner channel 16 is securely retained therein.

The mounting tang 56 is dimensioned so that the lower portion of tensioner channel 16 and which is formed a retainer recess 20 and abutted by the lower portion of the tang portion 56. The tensioner channel 16 is firmly fixed to the tang portion 56 by means of a self-tapping screw 66 passing through a slot 68 formed in the intermediate section of the tensioner channel 16 and threadably engaging a punched hole 70 adapted to threadably engage the self-tapping screw 66, such that each C-clip is firmly secured to the tensioner channel 16.

The lower or other tensioner channel 18 is retained within the opening 12 by means of a plurality of rigid clips 72 which may conveniently be provided by narrow sections of the same extrusion form as comprised the upper tensioner channel 16 and the lower tensioner channel 18 as can be seen in FIG. 2. Accordingly, this section has a lip 74 which is adapted to hook the lip edge 48 formed on the lower tensioner channel 18 as shown. Each of the rigid clips 72 are in turn respectively mounted within the opening 12 by means of angles 76 carried by means of screws or fasteners 78 to the frame 14 and to the rigid clip 72 by means of machine bolts 80 passing through slots 82 formed in the intermediate section of the rigid clip 72, an opening formed in the upper leg of the angle 76 and secured to the opening of the flexible panel 10.

It is noted that the various components are of extreme simplicity and of a configuration adapted to low cost fabrication, i.e., simple extrusion shapes or plastic strips or bars which may be formed in indeterminate lengths, which may be merely cut to size for any given requirement, such that extreme simplicity is achieved. The exterior appearance of the components with the molded appearance of the tensioner channels 16 and 18 afforded by their reversely bent edges provides a neat, clean exterior line which to some extent hides the fastener components comprised of the clips 50. The bottom mounting fastener of the rigid clip 72 is relatively small in size and unobtrusive.

At the same time, very secure and reliable retention of the flexible panel 10 both to the tensioner channels 16 and 18 and also the opening 12 is afforded which should reliably resist the weather forces with ease, while the installation and assembly thereof may be carried out without the use of tools in the case of the securement of the flexible panel 10 to the tensioner channels 16 and 18, or merely by use of an electric drill motor to secure the fastener components to the opening frame 14.

In addition, the adjustability afforded accommodates the mounting arrangement to various configurations of the frame surfaces 14 to which the flexible panel is to be mounted.

The C-clips 50 may be formed by a simple stamping of spring steel of one-piece construction which can be fabricated at extremely low cost. As noted, the simple extrudable shapes of the tensioner channels 16 and 18 and the rigid clips 72 contribute to this same advantage. The design of the C-clips 50 also affords relatively easy design control over its spring rate by virtue of the intermediate slots 58 and 60 to appropriately set the spring rate to the particular material to be mounted.

While this mounting arrangement has particular advantage in the context of solar films, i.e., open-weave plastic mesh, of course, any other suitable application in which a flexible panel is to be stretched or tensioned by a mounting arrangement and which need be easily released can also be utilized by the arrangement of the present invention.

While a specific embodiment has been described in accordance with the requirements of 35 USC 112, it is of course understood that many modifications are possible to the specifics disclosed within the scope of the appended claims.

The embodiments of the invention in which an exclusive property or privilege is claimed are defined as follows:

1. A mounting arrangement for mounting a flexible panel being stretched within said opening, the mounting arrangement including:

tensioner members secured to respective opposing edges of said flexible panel;

means for releasably securing one of said tensioner members to one side of said opening, including a releasable hooking engagement of said one of said tensioner members;

means for resiliently securing the other of said tensioner members within said opening;

said means including:

a plurality of C-clip members, each of said C-clips comprising a portion thereof affixed to the other side of said opening frame and including an intermediate resiliently deformable spring section and a mounting tang section secured to said other tensioner member;

said spring section of said C-clip adapted to exert a resilient tension force on said tensioner member and being sufficiently resiliently deformable to enable ready release of said hooking engagement of said one of said tensioner members by deflection thereof, whereby said flexible panel may be stretched within said opening while being readily releasable by disengagement of said hooking engagement.

2. The mounting arrangement according to claim 1 wherein each of said tensioner members comprises a tensioner channel, each of said tensioner channels including a lip edge formed along one side thereof, said other tensioner channel adapted to be engaged by tabs formed on each of said plurality of C-clips and hooked to said lip edge thereof.

3. The mounting arrangement according to claim 2 wherein said means mounting said tensioner channel member comprises a rigid clip having a hook portion adapted to engage said lip edge of said one tensioner channel to thereby releasably secure said one edge of said flexible panel within said opening.

4. The mounting arrangement according to claim 3 wherein each of said tensioner channels further includes a retainer recess formed along its length thereof, each of said recesses receiving a retainer bar adapted to be partially surrounded when disposed in a respective recess by said tensioner channel portions thereof and wherein respective of said flexible panels substantially pass around a respective retainer bar and each of said recesses including a recess opening thereof into which is passed said respective ends of said flexible panel in passing about each of said retainer bars.

5. The mounting arrangement according to claim 4 wherein each of said recesses includes a lip extending oppositely to the direction in which said flexible panel is stretched within said opening and around which said respective end of said flexible panel passes in passing into said retainer recess, whereby said flexible panel edges are frictionally retained within said recess by said retainer bar.

6. The mounting arrangement according to claim 5 wherein each of said retainer bars substantially occupies a respective recess, with a clearance for said flexible panel material to pass thereabout.

7. The mounting arrangement according to claim 6 wherein each of said recesses further includes a protuberance formed on each of said tensioner channel members and extending along said recess and forming a part thereof opposite said lip edge thereof and positioned to abut said retainer bars whereby said retainer bars are forced into engagement by the tensile forces developed on said flexible panel.

8. The mounting arrangement according to claim 2 wherein said rigid clip members comprise sections of a same cross section as comprise said tensioner members disposed with said lip portions in engagement with said lip portions on said one tensioner channel members.

9. The mounting arrangement according to claim 1 wherein said clip members are mounted for adjustment in and out of said opening.

10. The mounting arrangement according to claim 1 wherein said C-clip members are formed with a slotted portion extending through a portion of their length thereof whereby said resiliency of said C-clip members is enhanced.

11. The mounting arrangement according to claim 10 wherein said C-clip members comprise a mounting portion thereof extending into abutment with said opening frame and wherein said slot portion extends into said mounting portion whereby said slot provides said adjustment of said C-clip member in said framing opening.

12. The mounting arrangement according to claim 11 wherein said mounting tang extends for a dimension approximately corresponding to the width of said other tensioner channel member.

13. The mounting arrangement according to claim 2 wherein said C-clip member tang portion extends across said tensioner member from said point whereat said retainer recess is formed across to engage said lip edge with said tabs, whereby said mounting tang portion substantially co-extends with the width of said tensioner channel member.

14. The mounting arrangement according to claim 13 further including a screw fastener passing through said tensioner channel and threadably engaging said tang portion of each of said plurality of clips.

15. The mounting arrangement according to claim 2 wherein said tensioner channels are both formed of aluminum extrusions of identical cross-sectional shape.

* * * * *